US005443806A

United States Patent [19]

Isaksson et al.

[11] Patent Number: 5,443,806

[45] Date of Patent: Aug. 22, 1995

[54] TREATING EXHAUST GAS FROM A PRESSURIZED FLUIDIZED BED REACTION SYSTEM

[75] Inventors: Juhani Isaksson; Jari Koskinen, both of Karhula, Finland

[73] Assignee: A. Ahlstrom Corporation, Noormarkku, Finland

[21] Appl. No.: 215,945

[22] Filed: Mar. 22, 1994

[51] Int. Cl.[6] ..... F22B 1/00

[52] U.S. Cl. ..... 423/237; 423/235; 422/172; 422/147; 422/139; 422/171; 110/245; 122/4 D; 55/523; 431/7; 431/170

[58] Field of Search ..... 422/139, 147, 172, 177, 422/171; 110/245; 122/4 D; 431/7, 170; 423/235, 237; 55/523

[56] References Cited

U.S. PATENT DOCUMENTS

| | | | |
|---|---|---|---|
| 3,951,627 | 4/1976 | Barr, Jr. et al. | 55/284 |
| 4,029,752 | 6/1977 | Cahn | 423/563 |
| 4,343,631 | 8/1982 | Ciliberti | 55/302 |
| 4,417,908 | 11/1983 | Pitcher, Jr. | 55/523 |
| 4,525,184 | 6/1985 | Tassicker | 55/302 |
| 4,708,067 | 11/1987 | Narisoko et al. | 110/245 X |
| 4,869,207 | 9/1989 | Engström et al. | 122/4 D |
| 4,904,287 | 2/1990 | Lippert et al. | 55/302 |
| 5,190,451 | 3/1993 | Goldbach | 422/139 X |
| 5,241,825 | 9/1993 | Collin et al. | 60/655 |
| 5,261,354 | 11/1993 | Jonsson et al. | 122/4 D |
| 5,284,498 | 2/1994 | Davis et al. | 55/269 |
| 5,313,913 | 5/1994 | Oshita et al. | 122/4 D |

FOREIGN PATENT DOCUMENTS

WO91/01793 2/1991 WIPO .

*Primary Examiner*—Robert J. Warden
*Assistant Examiner*—Hien Tran
*Attorney, Agent, or Firm*—Nixon & Vanderhye

[57] ABSTRACT

Hot gases from a pressurized fluidized bed reactor system are purified. Under superatmospheric pressure conditions hot exhaust gases are passed through a particle separator, forming a flitrate cake on the surface of the separator, and a reducing agent—such as an $NO_x$ reducing agent (like ammonia), is introduced into the exhaust gases just prior to or just after particle separation. The retention time of the introduced reducing agent is enhanced by providing a low gas velocity (e.g. about 1–20 cm/s) during passage of the gas through the filtrate cake while at superatmospheric pressure. Separation takes place within a distinct pressure vessel the interior of which is at a pressure of about 2–100 bar, and-introduction of reducing agent can take place at multiple locations (one associated with each filter element in the pressure vessel), or at one or more locations just prior to passage of clean gas out of the pressure vessel (typically passed to a turbine).

28 Claims, 8 Drawing Sheets

TREATING EXHAUST GAS FROM A PRESSURIZED FLUIDIZED BED REACTION SYSTEM

The Government of the United States of America has rights in this invention pursuant to Contract No. DE-FC21-91MC-27364 awarded by the U.S. Department of Energy.

BACKGROUND AND SUMMARY OF THE INVENTION

The present invention relates to a method of treating gases from a pressurized fluidized bed reaction system. The invention reduces nitrogen emissions in connection with pressurized fluidized bed combustion performed in a fluidized bed of solids at a pressure above atmosphere.

For many years the emission requirements of industrial power plants have been under exhaustive investigations. New energy producing methods have been established and commercialized, with ever increasing pollutants capturing facilities and efficiencies, in a cost-effective way. In particular, it has long been desired to find cost effective ways to minimize nitrogen based pollutants, nitrogen oxides, $NO_x$, and nitric oxides, $N_2O$.

Nitrogen oxides can be formed during the combustion process mainly via three different reaction routes:

The first route is a direct oxidation of the molecular nitrogen by free oxygen radicals forming "thermic $NO_x$". The reaction route is, according to present knowledge, assumed to be as follows:

$$N_2+O=NO+N \quad (1a)$$

$$N+O_2=NO+O \quad (1b)$$

The formation of "thermic $NO_x$" depends on the concentration of the free oxygen atoms in a combustion reaction. Free oxygen atoms are formed only at high temperatures, and it has been assumed that at temperatures below 1700 K the amount of "thermic $NO_x$" is negligible in total $NO_x$ emission.

The second route is a reaction in a fuel rich zone between hydrocarbon radicals and molecular nitrogen forming HCN which is oxidated in the combustion chamber forming "prompt $NO_x$":

$$CH + N_2 = HCN + N \quad (2a)$$

$$HCN \xrightarrow{OH} NCO \xrightarrow{H} NH_x \xrightarrow{OH} NO \quad (2b)$$

Reaction rates of reactions (2a) and (2b) do not depend strongly on the temperature, and it is assumed that only in cold, fuel rich conditions are significant amounts of $NO_x$ is formed via these reactions.

According to the third route, fuels contain nitrogen which is bound in fuel material and is released during the combustion process, forming NO, $N_2O$ and $N_2$. Part of this nitrogen is released in the form of HCN or $NH_3$ with volatile matter, and part of nitrogen remains in char.

The homogenous reactions of HCN is considered to be the main source of nitrous oxide ($N_2O$) formed during combustion. The reaction route is:

$$HCN \xrightarrow{+O} CNO \xrightarrow{+NO} N_2O \quad (3)$$

Because $NO_x$ is mainly formed via oxidation of nitrogen compounds or nitrogen itself, the concentration of oxygen in the reactor has a clear effect on $NO_x$ emission in combustion. On the other hand, in low oxygen concentrations some carbon monoxide and other reducing agents may be formed which are known to reduce $NO_x$ and forming $N_2$.

In Swedish patent application 18903891 it has been suggested to inject ammonia ($NH_3$)into a pressurized fluidized bed reactor enclosed by a pressure vessel. The Swedish document suggests using an ammonia injection into flue gas in a pressure vessel before the gas turbine and after that catalytic reduction with additional injection of ammonia into the flue gases after the gas turbine. This document also teaches injection of additional ammonia based on measurement of the $NO_x$-content after the gas turbine and before catalytic reduction. However this and other known methods of removing nitrogen based pollutants in Pressurized Fluidized Bed Combustion systems still have shortcomings.

According to the invention, it has been found that significant amounts of $NO_x$ can be reduced to $N_2$ when $NH_3$ (or a like reducing agent) is injected into hot flue gases at superatmospheric pressure (typically over 2 bar, preferably about 2 to 100 bar). When $NH_3$ is injected at high enough temperatures, and the residence time for $NH_3$ in hot conditions is long enough, undesired side effects—e.g. increase in $N_2O$, CO and $NH_3$ emissions—can be almost totally avoided. This is especially so if the reducing agent is efficiently mixed with the gas and after that arranged to move slowly, e.g. at a velocity of about 1-20 cm/s (preferably about 1-5 cm/A) when passing through a particle separator.

According to one aspect of the present invention a method of purifying hot exhaust gases from a pressurized fluidized bed reactor system including a fluidized bed reactor within a pressure vessel, a separator for separating particulates from the exhaust gases, and a gas expansion device (e.g. turbine) for expanding the gas after separation of particles therefrom is provided. The method comprises the following steps: (a) Compressing gas to superatmospheric pressure. (b) Supplying the superatmospheric pressure gas to the fluidized bed reactor and pressure vessel so that the pressure within the pressure vessel is also superatmospheric. (c) Effecting chemical reactions in the fluidized bed reactor at superatmospheric pressure to produce hot exhaust gases containing gaseous impurities and particulates. (d) While maintaining superatmospheric pressure conditions, conveying the exhaust gases to the separator, effecting separation of particles from the exhaust gases with the separator to produce clean gas, and conveying the clean gas to the gas expansion device. And, (e) during the practice of step (d), introducing a reducing agent into the exhaust gases effective to reduce at least a significant proportion of the gaseous impurities in the-exhaust gases.

The gaseous impurities in the exhaust gases include nitrogen oxides, and step (e) is typically practiced to introduce a nitrogen oxides reducing agent, preferably $NH_3$, or nitrogen containing compound, CO, $CH_4$, or nitrogen producing compound. The particle separator typically includes a filtering surface on which a filter cake forms, and step (e) may be practiced between the fluidized bed and the filtrate cake, and also between the filtrate cake and the gas expansion device, or only between the flitrate cake and the gas expansion device. Step (e) may be practiced at a plurality of locations between the filtrate cake and the gas expansion device—for example where the separator comprises a plurality of clusters of filter elements, reducing agent may be injected at a location associated with each of the clusters.

Typically the pressure vessel comprises a first pressure vessel, and the separation device is mounted within a second pressure vessel exteriorly of and distinct from the first pressure vessel (the second pressure vessel also at superatmospheric pressure, preferably over 2 bar). Step (d) is also practiced to reduce the velocity of the exhaust gases between the first pressure vessel and the separation device so that the velocity of the exhaust gases when flowing the filtration device is about 1/10 to 1/1000 the velocity of the exhaust gases when leaving the fluidized bed. Typically the velocity is reduced so that when the exhaust gases flow through the filtration device their velocity is about 1–20 cm/s (preferably about 1–5 cm/s).

Under some circumstances it is desirable to introduce the reducing agent as or just before the clean gas exits the second pressure vessel, the velocity of the gas as it exits the second pressure vessel increasing significantly (at least doubling, and typically increasing to a value of about 10–1,000 times the velocity when passing through the separation device), so as to provide efficient mixing between the clean gas and reducing agent immediately after introducing of the reducing agent.

Step (e) is also preferably practiced so that the amount of introduced reducing agent is substantially only the minimum amount necessary to effect reduction of the gaseous impurities, so that there is no significant waste of reducing agent. Because of the pressurized conditions, small gas velocity, and particular points of introduction of reducing agent, provided according to the present invention, this desired result can be readily achieved.

According to another aspect of the present invention a method of purifying hot exhaust gases, having $NO_x$ and particles therein, from a PCFB (pressurized circulating fluidized bed) combustor is provided. The method utilizes a separator for separating particles from the exhaust gases contained within a pressure vessel, the separator having a plurality of filter surfaces each having a clean side and a dirty side. The method comprises the steps of: (a) Introducing flue gas from the PCFB combustor to the dirty sides of the filter surfaces in the pressure vessel. (b) Separating solid particles from the gas so that a flitrate cake builds up on the dirty sides of the filter surfaces. (c) Introducing $NO_x$ reducing agent into the gas associated with the clean sides of the filter surfaces. (d) Providing an optimized retention time of $NO_x$ reducing agent in the gas so as to optimize $NO_x$ reduction. And, (e) exhausting the gas, after the practice of steps (c) and (d), from the pressure vessel.

As indicated above the pressure in the pressure vessel is typically over 2 bar, preferably about 2 to 100 bar. That is step (d) is practiced by maintaining the pressure vessel at superatmospheric pressure of at least 2 bar. Step (d) is also further practiced by reducing the velocity of the gas substantially immediately after introduction into the pressure so that it is about 1/10 to 1/1000 the velocity of the gas prior to introduction into the pressure vessel; that is step (d) is further practiced to cause the gas to flow at a flow rate of about 1–20 cm/s (preferably about 1–5 cm/s) as it passes through the filter surface and prior to step (e).

According to another aspect of the present invention, a system for removing gaseous impurities and particles from hot gases is provided comprising the following elements: A pressure vessel at superatmospheric pressure and having a gas inlet and a gas outlet. A PCFB connected to the gas inlet. A plurality of filter elements mounted within the pressure vessel between the inlet and outlet, each filter element having a filter surface having a dirty side on which filtrate cake forms, and a clean side, the dirty side in communication with the gas inlet, and the clean side in communication with the gas outlet. And, at least one injector for injecting reducing agent into the pressure vessel between the clean sides of the filter surfaces and the gas outlet.

The system further comprises means for reducing the velocity of the gas introduced into the gas inlet so that the gas has a velocity of about 1–20 cm/s (preferably 1–5 cm/s) when flowing through the filter surfaces. The gas velocity reducing means may comprise an introduction duct provided within the pressure vessel between the gas inlet and the filter elements, for example providing a much larger volume than the conduit that the gas flows in prior to passage into the gas inlet so that the gas velocity is dramatically reduced. A turbine or a like gas expansion means is also connected to the gas outlet.

The at least one injector may comprise an injector associated with each of the filter elements; and/or an injector for injecting reducing agent into the gas at or just prior to where the gas exits the pressure vessel through the gas outlet, the gas outlet being constructed so that the velocity of the gas exits the gas outlet at least doubles so as to provide good mixing of reducing agent with the gas. The filter elements may comprise any suitable filter elements that can withstand the high temperature of the gases (which are typically always over 300° C., and may be as high as 1200° C.); suitable presently existing filter elements that can be used include ceramic candle filter elements and ceramic honeycomb filter elements, both of which are conventional per se.

The combination of the filtrate cake forming on the filtering surface, the superatmospheric pressure, and the relatively small velocity of the gas passing through the filtration cake, increase the retention time of the gaseous impurities associated with and in contact with the reducing agent, giving more time for purification chemical reaction as well as efficient mixing of the agent with the gaseous impurities.

It is the primary object of the present invention to provide an effective manner of purifying hot exhaust gases from a pressurized fluidized bed reactor system, particularly the removal of $NO_x$ therefrom, in an efficient manner, without substantial increase in $N_2O$, CO, or $NH_3$ emissions. This and other objects of the invention will become clear from an inspection of the detailed description of the invention and from the appended claims.

DETAILED DESCRIPTION OF THE DRAWINGS

Figure 1:
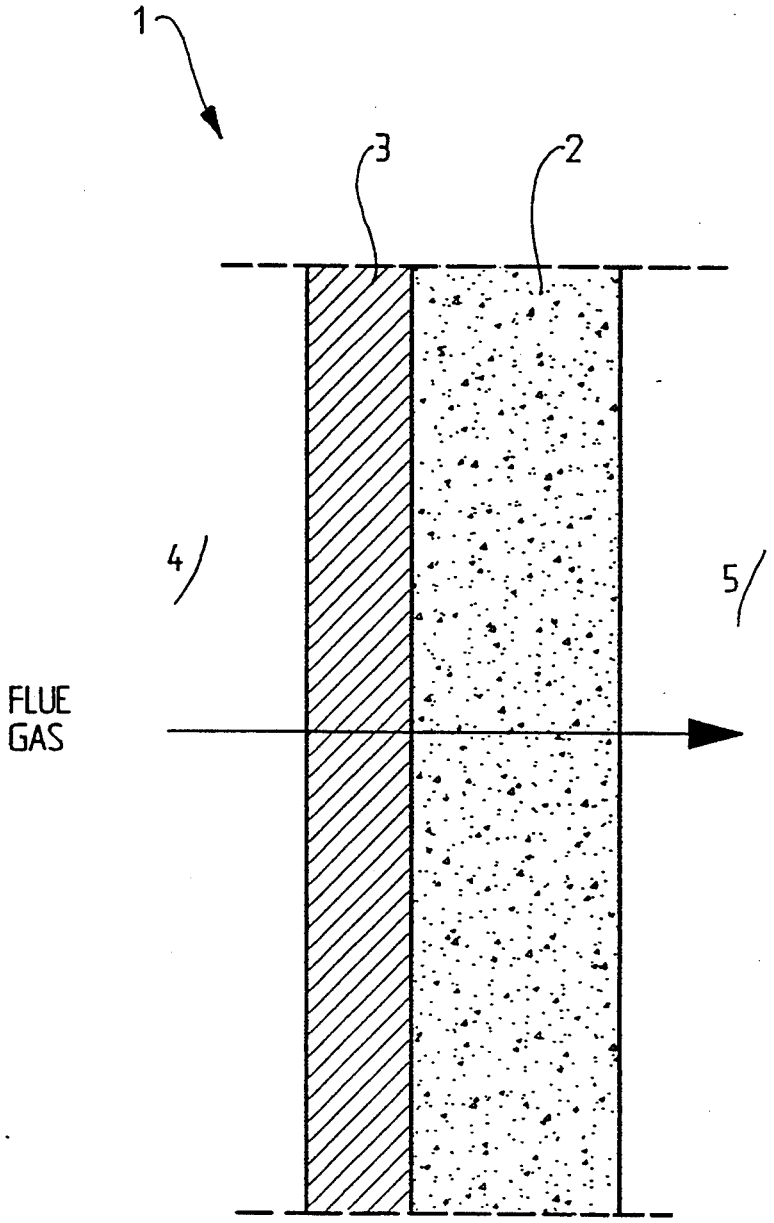
FIG. 1 is a schematic view depicting a filtering element surface of a High Temperature, High Pressure (HTHP) filter system according to a preferred embodiment of the present invention.

In a filtering element surface of a High Temperature, High Pressure (HTHP) filter system 1 of a Pressurized Fluidized Bed Combustion (PFBC) system according to a preferred embodiment of the present invention, a filtering surface 2 (see FIG. 1) is assembled in such a manner that HTHP flue gas from a Pressurized Fluidized Bed Reactor is caused to flow through the filtering surface 2. The filtering surface 2 must be constructed to endure high temperatures, at least about 300° C. and perhaps as high as 1200° C. According to present knowledge a ceramic filtering surface is preferred for this purpose. Filtration in hot conditions is under exhaustive research and, thus, it is evident that new solutions equivalent to or improvements over conventional ceramics will become commercially available in the future.

A separation of solid material (particulates) from the flue gas occur as the gas flows through the filtering surface 2, so that at the upstream side 4 of the filtering surface 2 the flue gas contains more solid particles than at the downstream side 5 of the filtering surface 2. Thus a dirty (upstream) side of the filter surface forms while the downstream side remains clean. Due to the separation effect, the solids on the dirty side tend to collect on the dirty side surface of the filtering element and form a layer of solid material 3, typically referred to as a filtrate cake.

According to the present invention, the flue gas is caused to come into contact with a nitrogen oxide reducing agent substantially in connection with the separation of solids under high pressure conditions using the system 1. By introducing (e.g. injecting) the nitrogen reducing agent into the flue gas prior to flowing through the filtering surface 2 and the filtrate cake 3, reduction of nitrogen oxide is enhanced by the flitrate cake 3 furnishing an additional means for nitrogen oxide and the reducing agent to react with each other. In this manner an efficient reduction of nitrogen oxide is provided in pressurized, high temperature circumstances.

It may, in some cases, be preferable to inject the nitrogen oxide reducing agent, such as $NH_3$, nitrogen providing agent, CO, $CH_4$, or nitrogen containing compound, into the flue gas on the clean side 5 of the filtering surface 2 in addition to, or instead of, injecting the reducing agent prior to the filtering surface 2. It has been found that in pressurized conditions the filtering surfaces should preferably be designed so that the gas velocities through the surfaces are low, e.g. a magnitude of about 1–20 cm/s, preferably about 1–5 cm/s. This surprisingly gives an advantageous prolongation of residence time of gas and nitrogen oxide reducing agent in the immediate vicinity of the clean side 5 of the filtering surface 2, and thus the emissions of nitrogen oxide compounds in the flue gas may be significantly diminished under superatmospheric pressure conditions (e.g. at least 2 bar, preferably about 2–100 bar).

Figure 2:
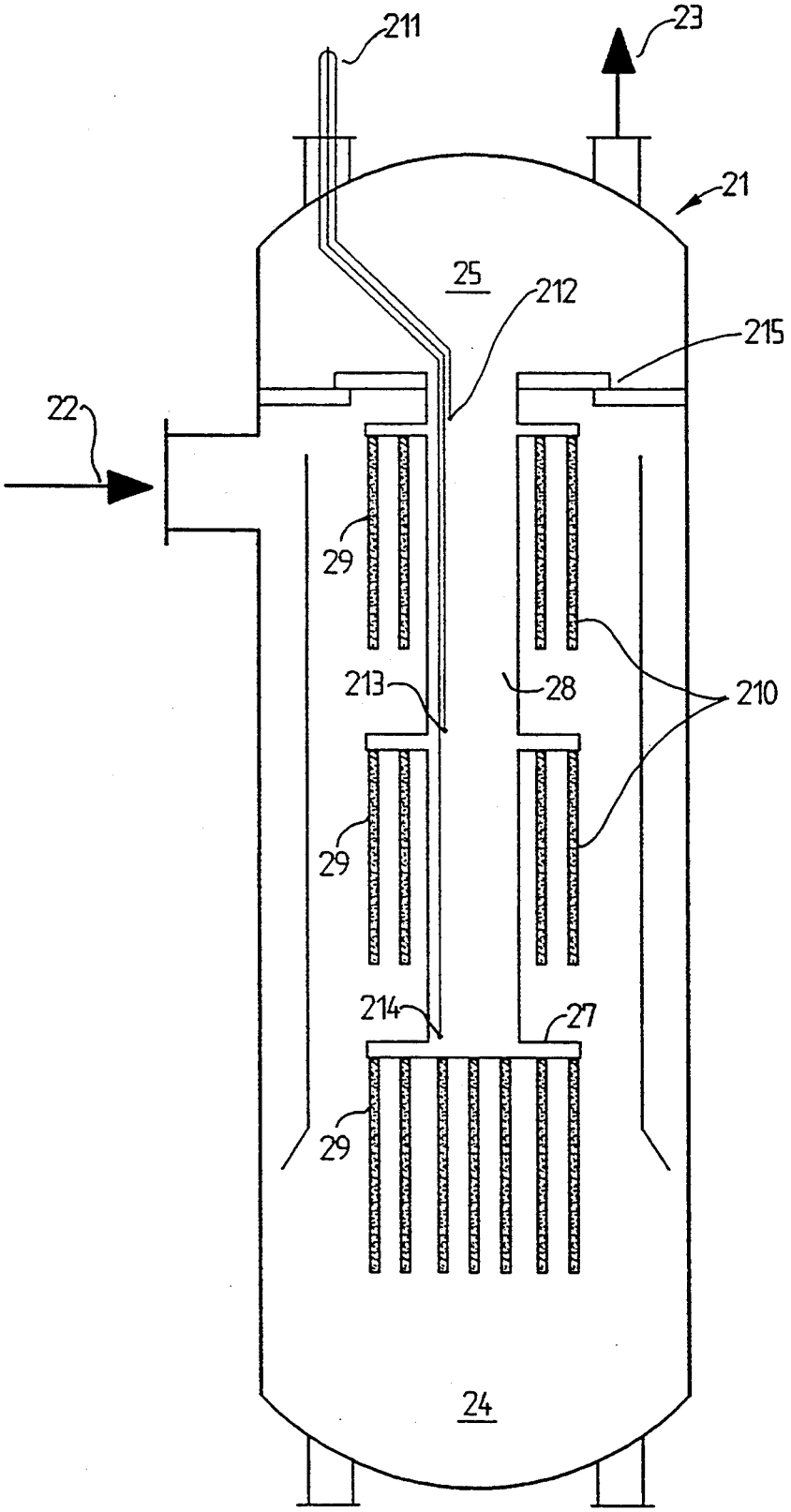
FIG. 2 is a schematic view depicting an exemplary embodiment of a pressure vessel for practicing a treatment sequence for hot gases according to present the invention.

One embodiment of the invention is illustrated in FIG. 2, showing. a system for treating gas at superatmospheric pressure, includes a pressure vessel 21 for practicing a treatment sequence for the hot exhaust gases from a Pressurized Circulating Fluidized Bed (PCFB) combustor (not shown in FIG. 2). Gas, e.g. flue gas, containing gaseous impurities and particulates from pressurized fluidized bed combustion, is introduced into the pressure vessel 21 via an inlet 22 to a first plenuni or dirty side 24 of the vessel 21. A filtering system supporting sheet 215 divides the vessel 21 into two portions: a dirty side (24) and a clean side, e.g. chamber 25, which is in communication with the clean gas outlet 23. The filtering system comprises a plurality of clusters 29 of filter elements 210 vertically spaced from each other in the dirty side 24 of the vessel 21. Depending on the structural construction there may be several filtering systems preferably horizontally spaced in the vessel (not shown in FIG. 2). The filter elements 210 are preferably hollow tube-like elements closed at one end and open at the other end, i.e. ceramic candle filters. The open end of each filter element 210 is connected to support system 28 in communication with the clean side chamber 25 of the vessel 21,-thus forming a plenum for collection of gas which flows through the filtering surface (2) of each filter element 2 10. Each cluster 29 has a plenum 27 is connected through the support or conduit system 28 to the clean side chamber 25 of the vessel 21 to enable flowing of clean gas out of the vessel 21 through outlet 23.

Impure gas is introduced into the vessel 21 through gas inlet 22 to the dirty side 24 of the vessel 21. The vessel 21 is constructed so that the velocity of the gas significantly decreases in the vessel 21 from the value in a conduit leading up to the inlet 22. Mean velocity in the inlet 22 may be 10 to 1000 times that in the vessel 21, e.g. so that the gas flow at a velocity of about 1–20 cm/s (e.g. 1–5 cm/s) when flowing through the filter elements 210.

After the separation of particles by elements 210 the conditions are favorable for effective $NO_x$ reduction by injection of $NO_x$-reducing agent (preferably $NH_3$) via ducts 211 at points 214, 213 and 212. Each location 214, 213 and 212 is preferably situated in the immediate vicinity of a plenum 27 collecting clean gas from the filter element clusters 29. At locations 212–214 favorable conditions prevail due to expected long retention times and the substantially particle free condition of the gas (i.e. the gas is clean). Moreover, the amount of injected reducing agent at each location may be adjusted so that minimum "reducing agent slip" is established (that is the amount of introduced reducing agent is only the amount necessary for reduction; an excess amount of agent is undesirable and avoided).

Figure 3:
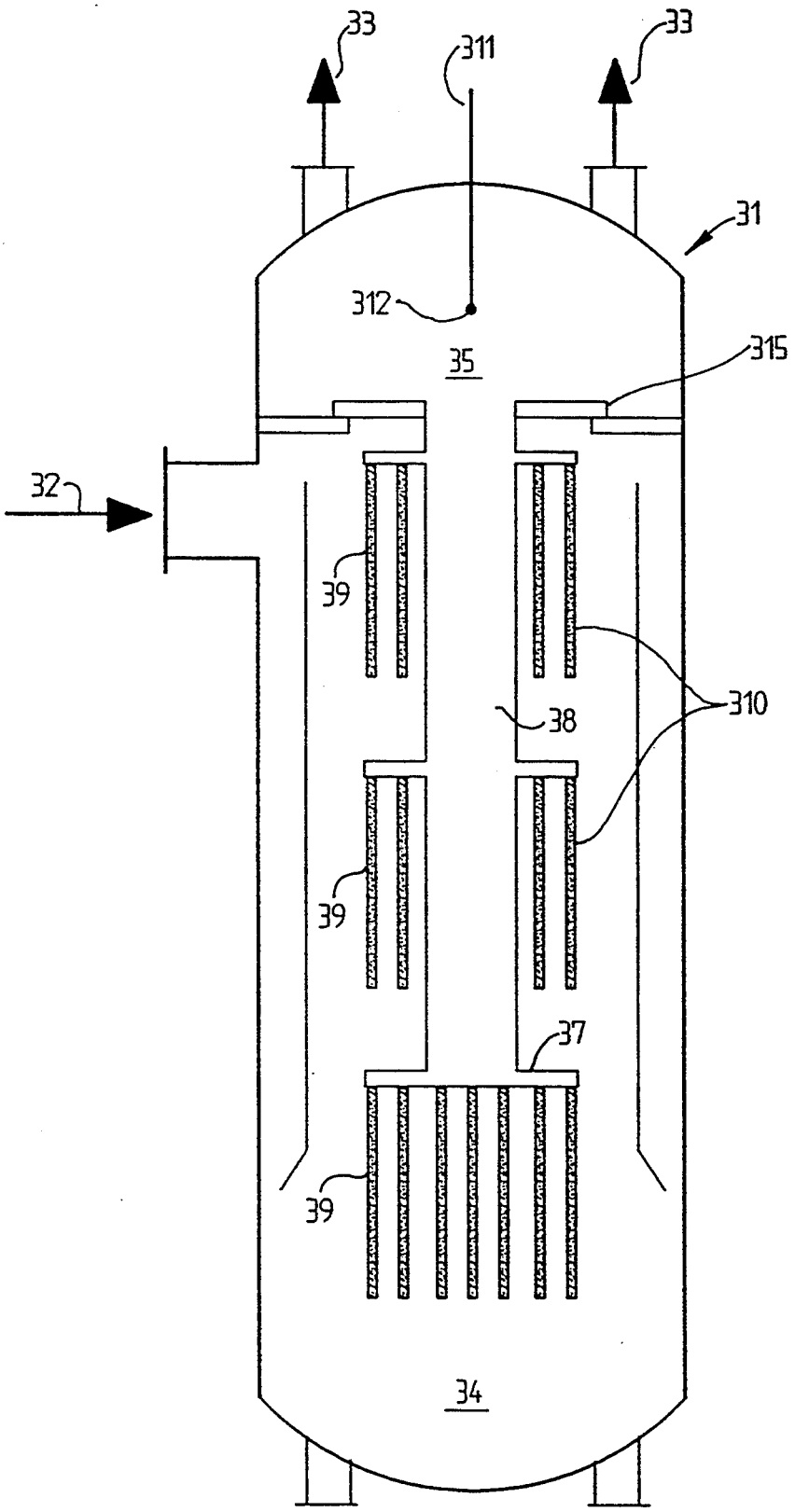
FIGS. 3–7 are schematic views like that of FIG. 2 for other exemplary pressure vessels for practicing the present invention.

FIG. 3 shows another embodiment of a pressure vessel according to the invention, i.e. a vessel 31 for practicing a treatment sequence for the hot gases under superatmospheric high temperature conditions. The reference numbers in FIG. 3 are analogous to FIG. 2, only the first digit is replaced with a "3".

In the FIG. 3, flue gas containing impurities from pressurized fluidized bed combustion is introduced into the vessel 31 via an inlet 32 to a first plenum 34 of the vessel. A filtering system supporting sheet 315 divides the vessel 31 into two portions: a dirty side (plenum 34) and a clean side, e.g. chamber 35 (which is connected with clean gas outlets 33). The filtering system comprises a plurality of clusters 39 of filter elements 310 vertically spaced in the dirty side 34 of the vessel. The filter elements 310 are preferably similar to those described in connection with FIGS. 1 and 2 e.g. ceramic candle filters. The open end of each filter element 310 is operatively connected to conduit system 38 for conveying clean gas from plenums 37 to the clean side chamber 35 of the vessel 31. Each cluster 39 has a plenum 37 connected through the conduit system 38 to the clean side chamber 35 of the vessel 31.

Impure flue gas is introduced into the vessel 31 through gas inlet 32 to the dirty side 34 of the vessel 31. The vessel is constructed so that the velocity of the gas greatly decreases in the vessel 31 from the value in the conduit leading to gas inlet 32. $NO_x$-reducing agent, preferably $NH_3$, is introduced via duct 311 and injection nozzle 312 into the clean side chamber 35 of the vessel 31. In the embodiment of the FIG. 3 the process parameters, such as used fuel, in the pressurized fluidized bed combustion reactor connected to inlet 32. are such that an adequate reducing condition for the flue gas is established by injecting reducing agent in clean side chamber 35, just prior to the, gases flowing out of the vessel 31 through outlets 33. In this manner, the installation of the reducing agent injection duct 311 is relatively simple. When the cleaned flue gas flows out of the vessel its velocity is increased rapidly (at least doubled), resulting in efficient mixing substantially immediately after the reducing agent is introduced.

Figure 4:
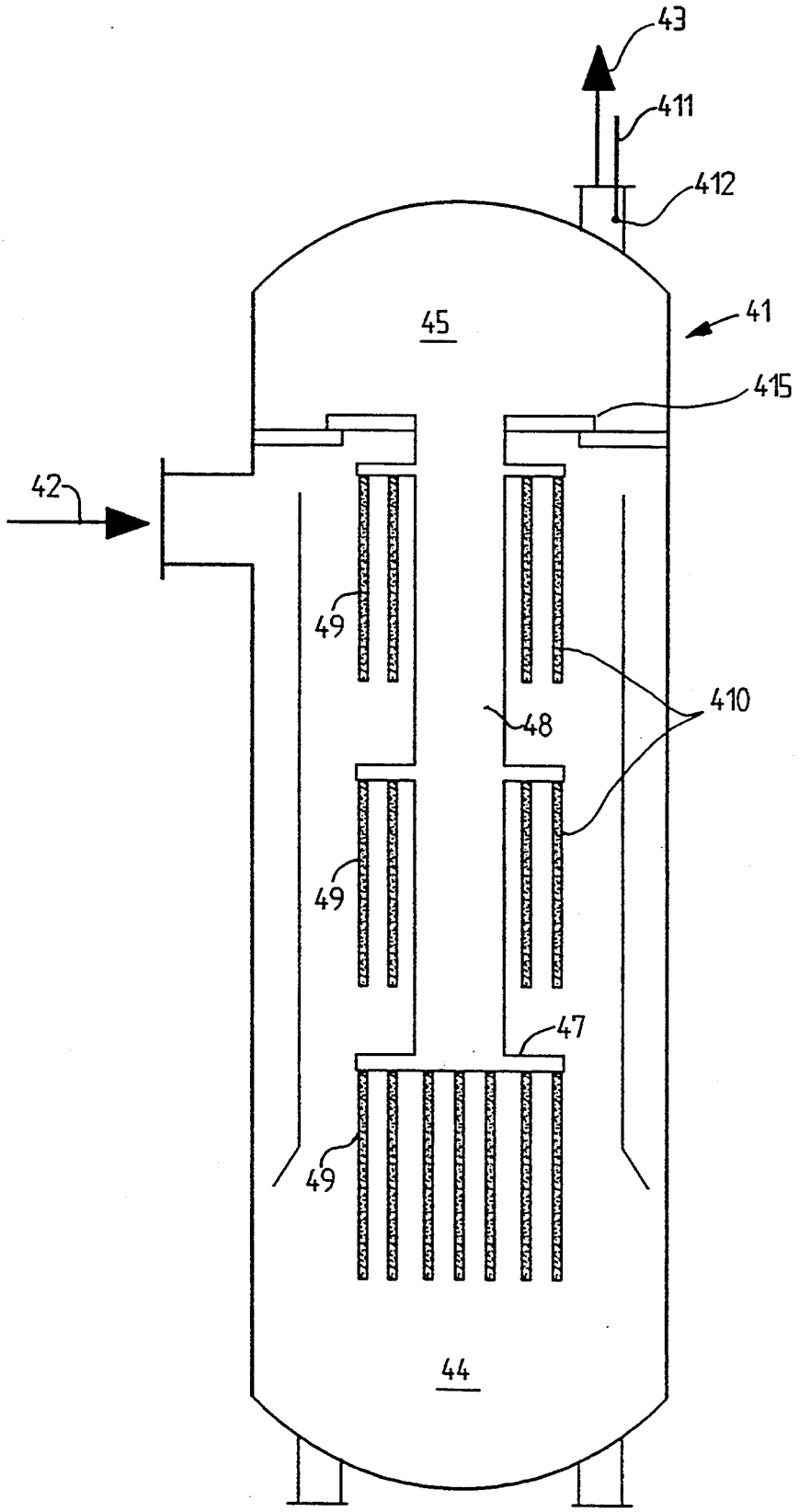

FIG. 4 illustrates another embodiment of the invention similar to that of FIG. 3 but having an injection location of reducing agent in a different position. Reference numbers in FIG. 4 are analogous to FIG. 3; only the first digit is replaced with "4".

Impure gas is introduced into the vessel 41 through gas inlet 42 to the dirty side of the vessel 41. The vessel is constructed so that the velocity of the gas decreases significantly in the vessel 41 from the value in the conduit leading up to inlet 42. $NO_x$-reducing agent, preferably $NH_3$, is introduced via duct 411 and injection nozzle 4 12 into the clean gas outlet 43 in the clean side chamber 45 of the vessel 41. The embodiment of the FIG. 4 may be advantageous when the process conditions allow the injection only to clean gas outlet position, and yet an adequate reducing condition for the flue gas may be established. When the flue gas is led out of the vessel 41 its velocity is increased rapidly, thus resulting in efficient mixing of agent and gas substantially simultaneously with the injection of the reducing agent. Further, this construction provides easy installation and maintenance of the duct 411 and nozzle 412.

Figure 5:
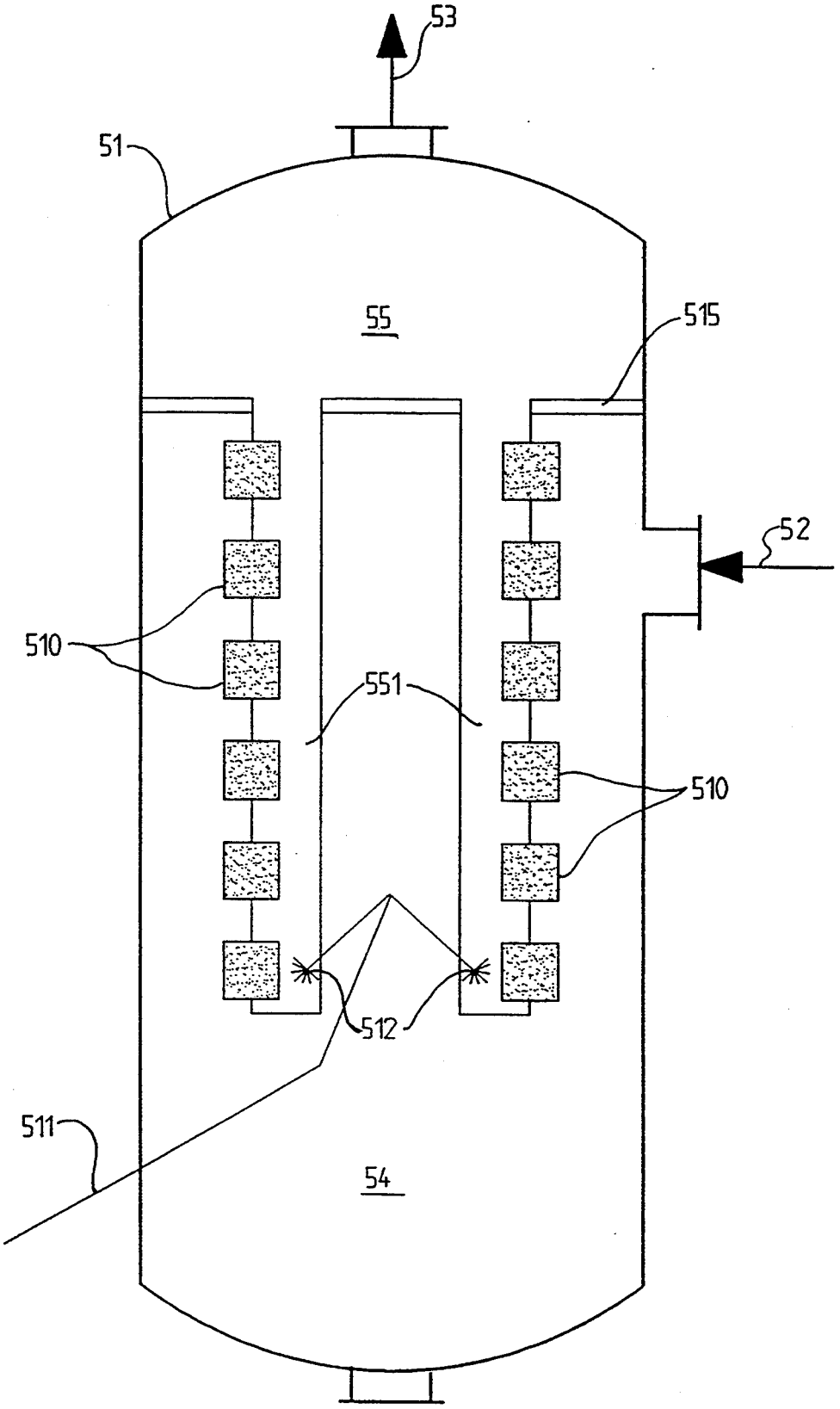

FIG. 5 illustrates a vessel 51 for practicing a treatment sequence for hot gases under superatmospheric pressure. Flue gas, containing impurities from pressurized fluidized bed combustion is introduced into the vessel 51 via an inlet 52 to a first plenum 54 of the vessel 51. A filtering system supporting sheet 515 divides the vessel 51 into two portions: a dirty side and a clean side, "clean" chamber 55 being connected to a clean gas outlet 53. The filtering system comprises a plurality of filter elements 510 vertically spaced in a support duct 551 which enables gas flow from each filter element 510 clean side to the clean side chamber 55 of the vessel 51. The support duct 551 is suspended on the sup- porting sheet 515. As illustrated, there may be a plurality of the support ducts 551 each having several filtering elements 510. There may also be several filtering elements spaced horizontally around the support duct at a same level. The filter elements 510 are preferably of a conventional ceramic honeycomb construction having a plurality of hollow passages or cells extending through them, which are formed in whole or in part by thin porous interconnected walls through which the gas to be filtered flows. Each filter element 510 is connected to a support duct 551 in such a manner that clean gas enters into the support duct 551. Each duct 551 thus forms a plenum for collection of gas which flows through the filtering surface of each filter element 510.

Impure flue gas is introduced into the vessel 51 through a gas inlet 52 to the dirty side of the vessel 51. The vessel is constructed so that the velocity of the gas decreases significantly (e.g. 1/10–1/1000 its previous level) when it enters the vessel 51. $NO_x$-reducing agent, preferably $NH_3$ is introduced via duct 511 at locations 512. Each location 512 is preferably situated in the lowermost portion of a support duct 551. At locations 512 favorable conditions for reduction exist. In the support duct 551 the reducing agent may commence reduction, which then continues all the way to the clean side chamber 55, wherein an additional increase in the retention time is established by the volume of the chamber 55. Moreover, the amount of injected reducing agent at each location may be so adjusted that a minimum "reducing agent slip" is established.

Figure 6:
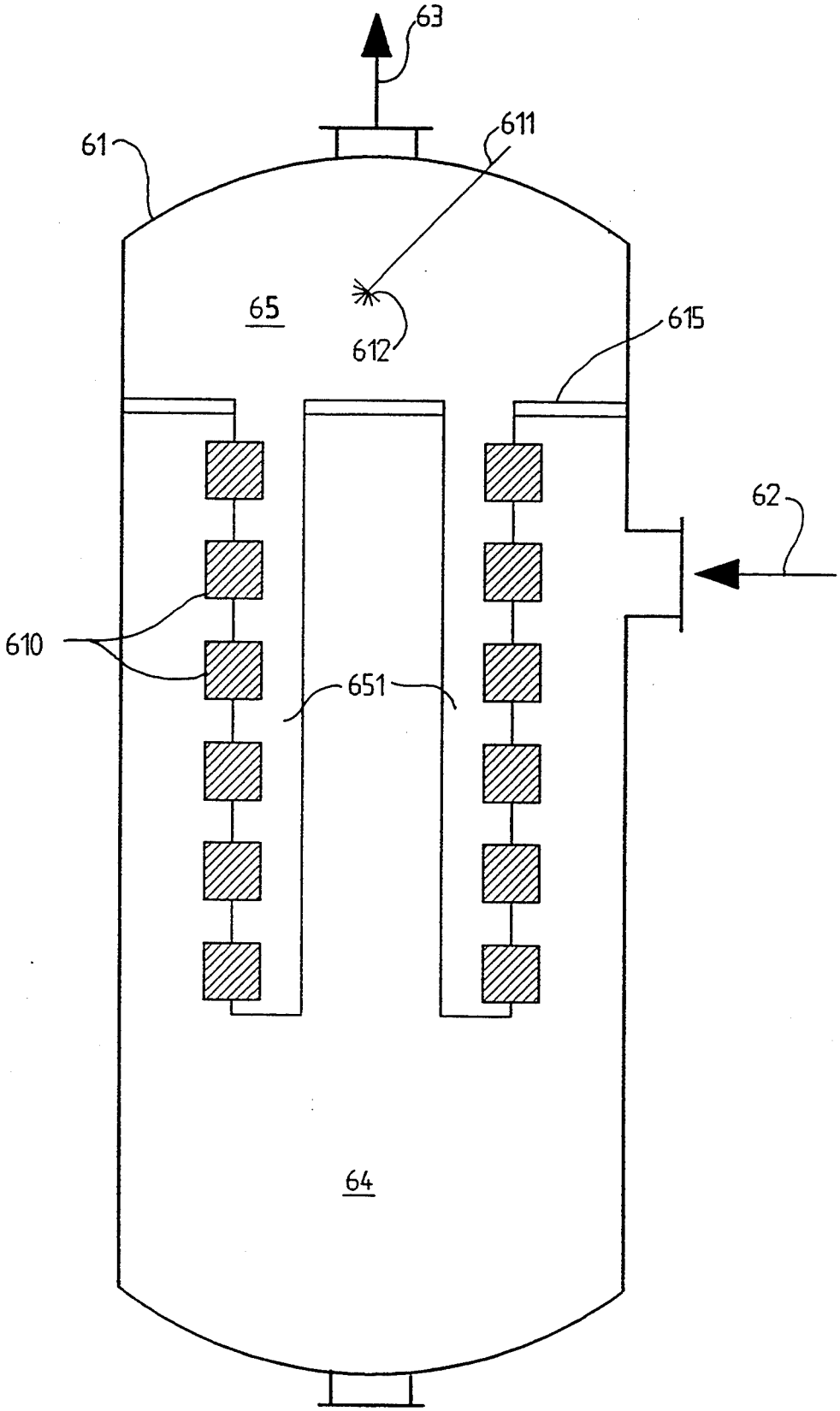

In FIG. 6 there is another embodiment otherwise similar to the one shown if FIG. 5 but having the reducing agent injection location in a different position. Reference numbers in FIG. 6 are analogous to FIG. 5; only the first digit is replaced with "6". $NO_x$-reducing agent, preferably $NH_3$, is introduced via duct 611 and injection nozzle 612 into the clean side chamber 65 of the vessel 61. The embodiment of the FIG. 6 may be advantageous in such cases in which the process allows the reducing agent to be injected in the collection chamber 65, prior to clean gases flowing out of the vessel 61. When the cleaned flue gas flow out of the vessel, its velocity is increased rapidly, thus resulting in efficient mixing substantially immediately after injection of the reducing agent.

Figure 7:
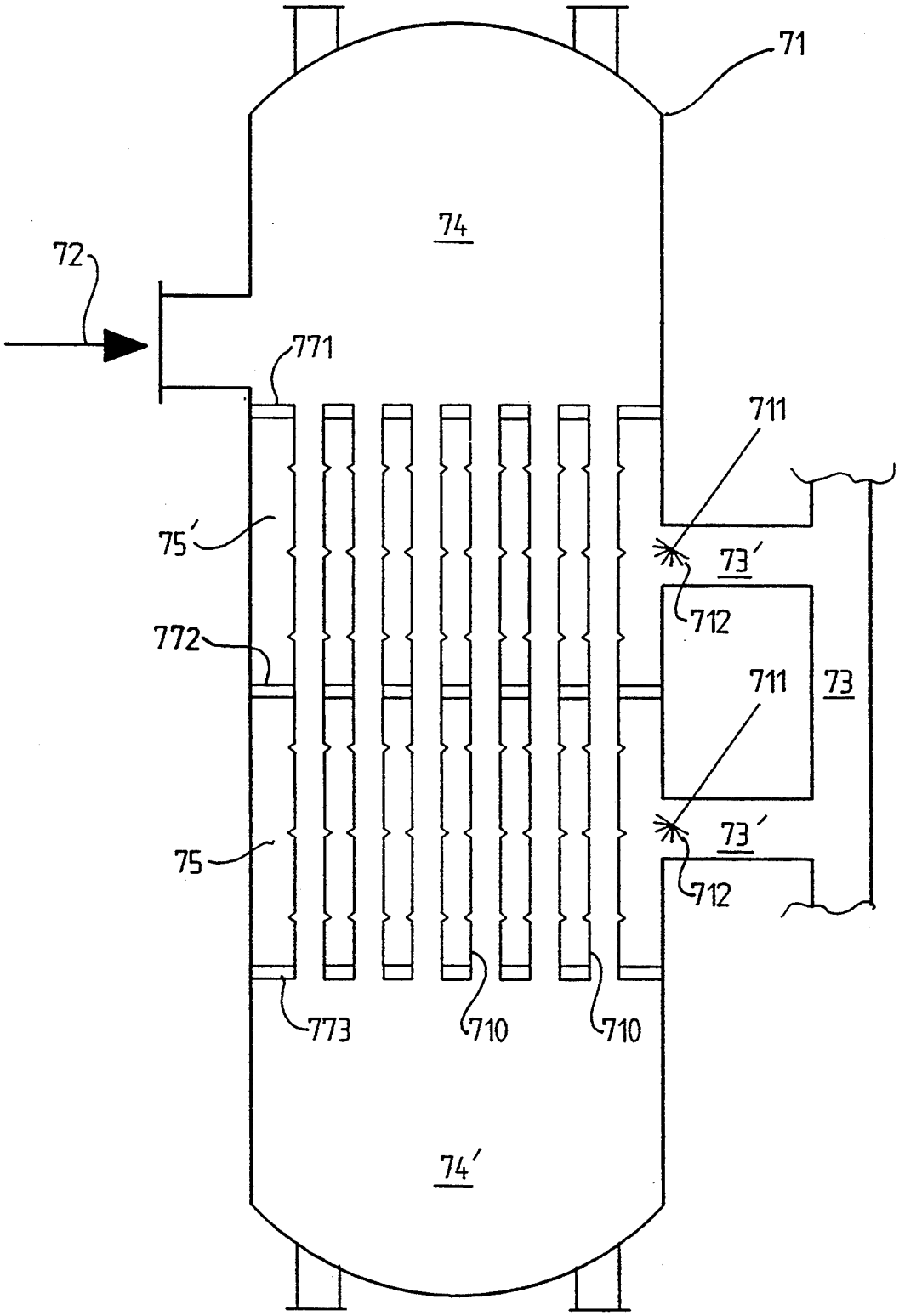

FIG. 7 shows a vessel 71 for practicing a treatment sequence for hot gases from a PCFB combustor under superatmospheric pressure. Flue gas containing impurities issued from pressurized fluidized bed combustion is introduced into the vessel 71 via an inlet 72 to a first plenum or chamber 74. The vessel 71 is divided into several compartments 75 and 75' by providing partitions 771, 772 and 773 spaced vertically inside the vessel 71. The partitions 771–773 are provided with openings spaced so as to allow an assembly of substantially vertical hollow filtering members 710 extending through the openings. The hollow filtering members 710 thus connect the chambers 74 and 74' with each other. The gas containing impurities flows from the plenum 74 into the filtering members 710, through the filtering surface of each filtering element 710 to the compartments 75 and 75' while solid particles are separated from the gas on the inner surface of hollow separating members 710. The gas is conveyed from the compartments 75 and 75' via conduits 73' to the gas outlet conduit 73.

$NO_x$-reducing agent, preferably $NH_3$, is introduced via ducts 711 into locations 712 in each conduit 73'. In the immediate vicinity of each compartment 75 collecting clean gas from the filtering members 710. The amount of injected reducing agent at each location 712 may be so adjusted that a minimum "reducing agent slip" is established. In this manner efficient mixing is established since the gas first flows in conduits 73' a distance such that the flow pattern has not fully developed prior to the gas being introduced into gas outlet conduit 73. The introduction of the gas causes an additional mixing effect, thus enhancing reduction chemical reactions.

Figure 8:
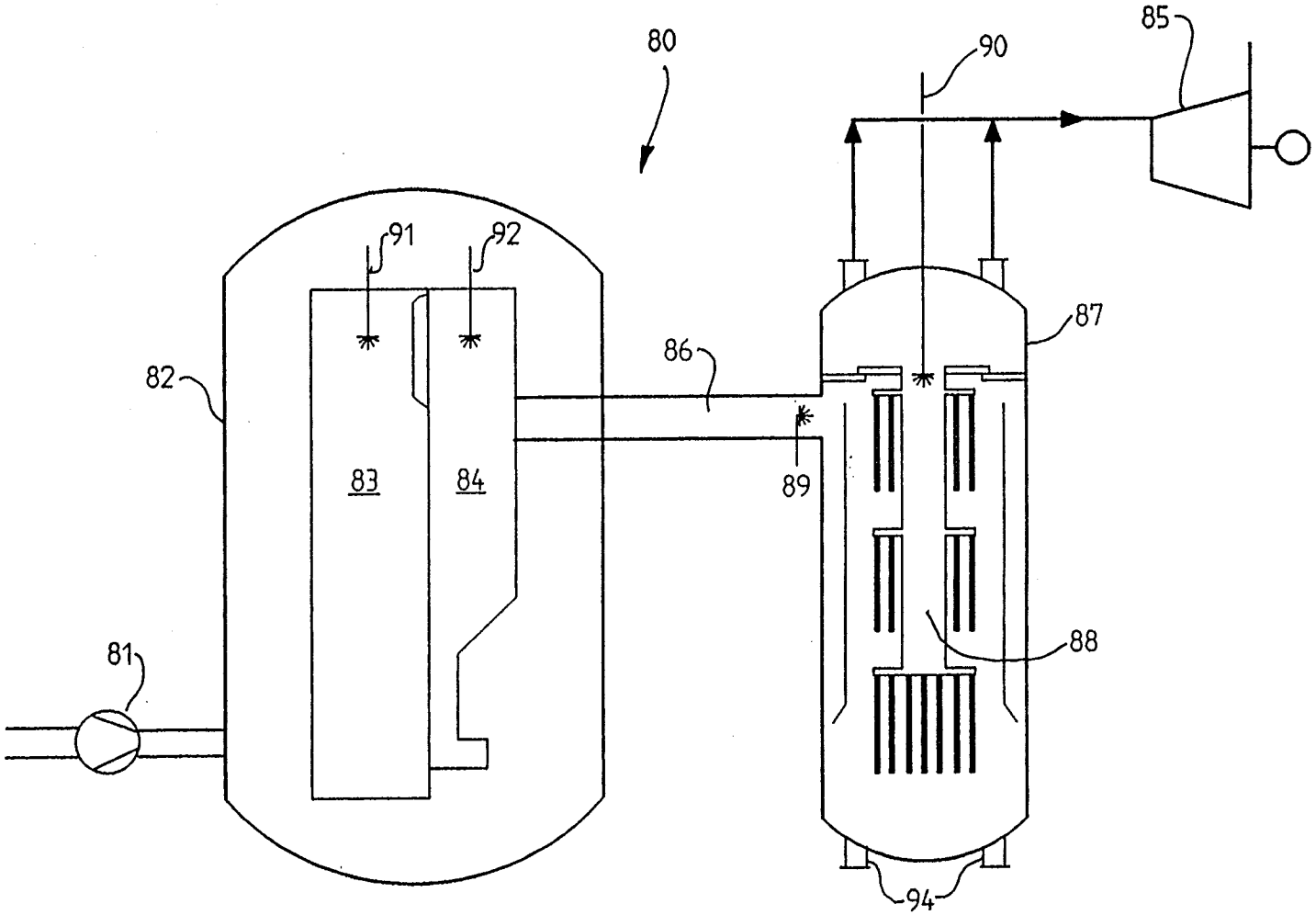
FIG. 8 is a schematic view depicting a Pressurized Circulating Fluidized Bed Combustion reactor system connected to a pressure vessel for practicing a treatment sequence for the hot gases according to the present invention.

FIG. 8 is shows a pressurized circulating fluidized bed reactor system 80. The pressurized circulating fluidized bed reactor system, i.e. PCFB reactor system 80, includes a gas compression means 81, such as a gas compressor, a pressure vessel 82 enclosing a circulating fluidized bed reactor 83, a cyclone separator 84, and a gas expansion means (e.g. turbine) 85. Gas is compressed a superatmospheric pressure (e.g. 2–100 bar) is supplied to the fluidized bed reactor 83 inside the pressure vessel 82 to provide superatmospheric pressure conditions in the pressurized. circulating fluidized bed reactor system 80. A circulating fluidized bed of solids is maintained in the fluidized bed reactor 83 in a manner know in the art. The hot gas resulting from chemical reactions in the circulating fluidized bed, entraining solid material, is introduced into the cyclone separator 84 for separation of solids. The flue gas substantially free of large solids, but still containing gaseous impurities and small particulates is conveyed via conduit 86 to a pressure vessel 87 for practicing a superatmospheric treatment sequence for the hot gas.

The pressure vessel 87 may have any of the constructions of FIGS. 2–7. According to the present invention, a treatment/sequence is established to the gas, the sequence comprising: conveying the gas from the fluidized bed reactor 83 via the conduit 86 to the hot gas particulate separation means 88 in superatmospheric pressure vessel 87, separating a portion of particulate material from the hot gas to produce clean gas, and conveying the clean gas to the gas expansion means 85. While practicing the treatment sequence, gaseous impurities reducing agent, such as $NH_3$, is injected via conduits 89 and/or 90 to react with the gaseous impurities in the hot pressurized gas. According to the present invention the flue gas is brought into contact with a nitrogen oxide reducing agent when the separation of solids is being practiced. By injecting the nitrogen reducing agent into the flue gas prior to the flue gas flowing through the separation means 88 at location 89, reduction of nitrogen oxide is enhanced. In this manner, an efficient reduction of nitrogen oxide is provided under superatmospheric pressure, high temperature (i.e. about 300° C.–1200° C.) conditions. There may be (usually) steam-generation surfaces in the PCFB; evaporating wall-structure or tube banks e.g. in the furnace for (combustion) reaction controlling. In normal operation pressure is not intentionally reduced, and between the first and second pressure vessels 82, 87 the temperature of the gas is normally not intentionally reduced. Typically also the pressure is not intentionally significantly reduced between vessels 82 and 87.

In some cases it is preferable to inject the nitrogen oxide reducing agent into the flue gas on the clean side of the separation means 88, i.e. via conduit 90, instead of (or in additional to) injecting it at 89 prior to the separation means 88. It has been found that at superatmospheric conditions the filtering surfaces may be designed so that the velocity of the gas flowing therethrough is low (e.g. 1–20 cm/s, preferably 1–5 cm/s). This surprisingly gives an advantageous prolongation of residence time of gases and nitrogen oxide reducing agent in the immediate vicinity to the clean side of the filtering surface, and thus the emissions of nitrogen oxide compounds in the flue gas may be diminished. If the residence time is increased the optimum temperature for ammonia injection is also decreased within certain limits. Therefore the residence time provided by injection of reducing agent into the clean side of the separation means is very advantageous.

It may be advantageous in some cases, in addition to having reducing agent injections arranged at locations 89 and 90, to provide ducts 91 and/or 92 for further injections into the reactor 83 and/or the cyclone separator 84. In this way the injection of reducing agent may be controlled so that the amount and location of injection is selected according to e.g. load of the pressurized circulating fluidized bed reactor system 80 so that an optimum retention time and reduction of $NO_x$ may be established for all operating conditions of the system 80.

The filtering element surfaces in conjunction with all the embodiments of FIGS. 2 through 8 are substantially comparable to the filtering element surface described in more detail in connection with FIG. 1.

The system 80 may also contain other conventional components, such as safety systems, backflush pulsing systems for cleaning the separators 88, separated particles removing systems (e.g. connected to particles discharges 94), and the like.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of purifying exhaust gases having a temperature of at least about 300° C. from a pressurized fluidized bed reactor system including a fluidized bed reactor within a first pressure vessel, a filtering surface filtration device separate and distinct from any cyclone separators for separating particulates from the exhaust gases and forming filtrate cake on surface of the filtration device, the filtration device mounted in a second pressure vessel exteriorly of and distinct from the first pressure vessel, and a gas expansion device for expanding the gas after separation of particles therefrom, comprising the steps of:

(a) compressing gas to superatmospheric pressure;

(b) supplying the superatmospheric pressure gas to the fluidized bed reactor and pressure vessel so that the pressure within the pressure vessel is also superatmospheric;

(c) effecting chemical reactions in the fluidized bed reactor at superatmospheric pressure to produce exhaust gases having a temperature of at least about 300° C. containing gaseous impurities and particulates;

(d) while maintaining superatmospheric pressure conditions, conveying the exhaust gases to the filtration device, effecting filtration of particles from the exhaust gases with the filtration surface to produce clean gas while causing particles filtered out to form a filtrate cake, and conveying the clean gas to the gas expansion device and reducing the velocity of the exhaust gases between the first pressure vessel and the filtration device so that the velocity of the exhaust gases when flowing through the filtration device is about 1–20 cm/s; and (e) during the practice of step (d), introducing a reducing agent into the exhaust gases effective to reduce at least a significant proportion of the gaseous impurities in the exhaust gases.

2. A method as recited in claim 1 wherein the gaseous impurities in the exhaust gases include nitrogen oxides, and wherein step (e) is practiced to introduce a nitrogen oxides reducing agent.

3. A method as recited in claim 2 wherein step (e) is further practiced to introduce a reducing agent selected from the group consisting of $NH_3$, nitrogen containing compound, CO, $CH_4$ and nitrogen producing compound.

4. A method as recited in claim 2 wherein step (e) is practiced between the fluidized bed reactor and the surface where flitrate cake forms.

5. A method as recited in claim 4 wherein step (e) is also practiced between surface where the filtrate cake and the gas expansion device.

6. A method as recited in claim 2 wherein step (e) is practiced at one or more locations between the surface where flitrate cake forms and the gas expansion device.

7. A method as recited in claim 6 wherein step (e) is practiced only at one location between the surface where filtrate cake forms and the gas expansion device.

8. A method as recited in claim 2 wherein step (e) is practiced in a plurality of stages.

9. A method as recited in claim 2 wherein the filtration device comprises a plurality of clusters of filtering elements connected to a common clean gas duct; and wherein step (e) is practiced to inject reducing agent into the clean gas duct at respective a different location for each cluster of filtering elements.

10. A method as recited in claim 2 wherein the filtration device comprises a plurality of tubular filtering elements each having a dirty side and a clean side, and wherein step (e) is practiced to inject reducing agent at the clean side of each filtering element, at a respective different location for each filtering element.

11. A method as recited in claim 1 and wherein step (d) is also practiced to reduce the velocity of the exhaust gases between the first pressure vessel and the filtration device so that the velocity of the exhaust gases when flowing through the filtration device is about 1/10 to 1/1000 the velocity of the exhaust gases when having the fluidized bed reactor.

12. A method as recited in claim 1 wherein step (d) is further practiced by passing the cleaned gas from the second pressure vessel to the gas expansion device located in a position exteriorly of the second pressure vessel in a manner such that the velocity of the cleaned gas at least doubles as it exits the second pressure vessel; and wherein step (e) is practiced to introduce the reducing agent as or just before the clean gas exits the second pressure vessel so as to provide efficient mixing between the cleaned gas and reducing agent immediately after introduction of the reducing agent.

13. A method as recited in claim 1 wherein step (e) is practiced so that the amount of introduced reducing agent is substantially only the minimum amount necessary to effect reduction of the gaseous impurities.

14. A method as recited in claim 1 wherein the filtration device comprises a plurality of tubular filtering elements each having a dirty side and a clean side, and wherein step (e) is practiced to inject reducing agent at the clean side of each filtering element, at a respective different location for each filtering element.

15. A method as recited in claim 1 wherein the superatmospheric pressure is 2–100 bar during the practice of all of steps (a)–(e).

16. A method as recited in claim 1 wherein step (d) is practiced so that the velocity of the exhaust gases when flowing through the filtration device is about 1–5 cm/s.

17. A method of purifying exhaust gases having a temperature of at least about 300° C., having $NO_x$ and particles therein, from a pressurized circulating fluidized bed combustor, utilizing a separator contained within a pressure vessel for separating particulates from the exhaust gases, the separator having a plurality of filter surfaces each having a clean side and a dirty side; comprising the steps of:

(a) introducing exhaust gas from the pressurized circulating fluidized bed combustor having a temperature of at least about 300° C. to the dirty sides of the filter surfaces in the pressure vessel;

(b) separating solid particles from the exhaust gas with the filter surfaces so that a filtrate cake builds up on the dirty sides of the filter surfaces;

(c) introducing $NO_x$ reducing agent into the gas associated with the clean sides of the filter surfaces;

(d) providing an optimized retention time of $NO_x$ reducing agent in the gas so as to optimize $NO_x$ reduction;

(e) exhausting the gas, after the practice of steps (c) and (d), from the pressure vessel; and wherein step (d) is practiced by causing the exhaust gas to flow at a flow rate of about 1–20 cm/s as it passes through the filter surfaces, and prior to step (e).

18. A method as recited in claim 17 wherein step (d) is practiced by maintaining the pressure vessel at superatmospheric pressure of at least two bar.

19. A method as recited in claim 18 wherein step (d) is further practiced by reducing the velocity of the gas substantially immediately after introduction into the pressure vessel so that it is about 1/10 to 1/1000 the velocity of the gas prior to introduction into the pressure vessel.

20. A method as recited in claim 18 wherein step (d) is further practiced by causing the exhaust gas to flow at a flow rate of about 1–5 cm/s as it passes through the filter surfaces, and prior to step (e).

21. A method of purifying exhaust gases having a temperature of at least about 300° C. from a pressurized fluidized bed reactor system including a fluidized bed reactor within a pressure vessel, a filtering surface filtration device separate and distinct from any cyclone separators for separating particulates from the exhaust gases and on which flitrate cake forms and comprising a plurality of tubular filtering elements each having a dirty side and a clean side, and a gas expansion device for expanding the gas after separation of particles therefrom, comprising the steps of:

(a) compressing gas to superatmospheric pressure;

(b) supplying the superatmospheric pressure gas to the fluidized bed reactor and pressure vessel so that the pressure within the pressure vessel is also superatmospheric;

(c) effecting chemical reactions in the fluidized bed reactor at superatmospheric pressure to produce exhaust gases having a temperature of at least about 300° C. containing gaseous impurities and particulates;

(d) while maintaining superatmospheric pressure conditions, conveying the exhaust gases to the filtration device, effecting filtration of particles from the exhaust gases with the filtration surface to produce clean gas while causing particles filtered out to form a flitrate cake, and conveying the clean gas to the gas expansion device; and (e) during the practice of step (d), introducing a reducing agent into the exhaust gases effective to reduce at least a significant proportion of the gaseous impurities in the exhaust gases, by injecting reducing agent at the clean side of each filtering element, at a different location for each filtering element.

22. A method as recited in claim 21 wherein the gaseous impurities in the exhaust gases include nitrogen oxides, and wherein step (e) is practiced to introduce a nitrogen oxides reducing agent.

23. A method as recited in claim 21 wherein the superatmospheric pressure is 2–100 bar during the practice of all of steps (a)–(e).

24. A method of purifying exhaust gases having a temperature of at least about 300° C. from a pressurized fluidized bed reactor system including a fluidized bed reactor within a first pressure vessel, a filtering surface filtration device separate and distinct from any cyclone separators for separating particulates from the exhaust gases and on which flitrate cake forms the filtering device mounted in a second pressure vessel exteriorly of and distinct from the first pressure vessel, and a gas expansion device for expanding the gas after separation of particles therefrom, comprising the steps of:

(a) compressing gas to superatmospheric pressure;

(b) supplying the superatmospheric pressure gas to the fluidized bed reactor and the first pressure vessel so that the first pressure within the pressure vessel is also superatmospheric;

(c) effecting chemical reactions in the fluidized bed reactor at superatmospheric pressure to produce exhaust gases having a temperature of at least about 300° C. containing gaseous impurities and particulates;

(d) while maintaining superatmospheric pressure conditions, conveying the exhaust gases to the filtration device, effecting filtration of particles from the exhaust gases with the filtration surface to produce clean gas while causing particles filtered out to form a flitrate cake, and reducing the velocity of the exhaust gases between the first pressure vessel and the filtration device so that the velocity of the exhaust gases when flowing through the filtration device is about 1/10 to 1/1000 the velocity of the exhaust gases when leaving the fluidized bed reactor and conveying the clean gas to the gas expansion device; and (e) during the practice of step (d), introducing a reducing agent into the exhaust gases effective to reduce at least a significant proportion of the gaseous impurities in the exhaust gases.

25. A method as recited in claim 24 wherein step (b) is practiced at one or more locations between the surface where filtrate cake forms and the gas has an expansion device.

26. A method as recited in claim 24 wherein the gaseous impurities in the exhaust gases include nitrogen oxides, and wherein step (e) is practiced to introduce a nitrogen oxides reducing agent.

27. A method as recited in claim 24 wherein step (e) is practiced so that the amount of introduced reducing agent is substantially only the minimum amount necessary to effect reduction of the gaseous impurities.

28. A method as recited in claim 24 wherein the filtration device comprises a plurality of tubular filtering elements each having a dirty side and a clean side, and wherein step (e) is practiced to inject reducing agent at the clean side of each filtering element, at a different location for each filtering element.

* * * * *